United States Patent [19]

Averill

[11] 4,394,819

[45] Jul. 26, 1983

[54] VIBRATION ISOLATION AND PRESSURE COMPENSATION APPARATUS FOR SENSITIVE INSTRUMENTATION

[75] Inventor: Robert D. Averill, Newport News, Va.

[73] Assignee: The United States of America as represented by the Administrator of the National Aeronautics and Space Administration, Washington, D.C.

[21] Appl. No.: 408,575

[22] Filed: Aug. 16, 1982

[51] Int. Cl.[3] ..... F25B 19/00

[52] U.S. Cl. ..... 62/514 R; 62/295; 248/636; 248/638

[58] Field of Search ..... 62/55.5, 295, 514 R; 248/636, 638

[56] References Cited

U.S. PATENT DOCUMENTS

| | | | |
|---|---|---|---|
| 3,609,992 | 10/1971 | Cacheux | 62/514 R |
| 3,742,729 | 7/1973 | Zulliger | 62/514 R |
| 3,894,403 | 7/1975 | Longsworth | 62/514 R |
| 4,363,217 | 12/1982 | Venuti | 62/295 |

*Primary Examiner*—Ronald C. Capossela

*Attorney, Agent, or Firm*—Howard J. Osborn; John R. Manning; Wallace J. Nelson

[57] ABSTRACT

A system for attenuating the inherent vibration associated with a mechanical refrigeration unit employed to cryogenically cool sensitive instruments used in measuring chemical constituents of the atmosphere. A modular system including an instrument housing 13 and a reaction bracket 14 with a refrigerator unit 15 "floated" therebetween comprise the instrumentation system. A pair of evacuated bellows 20,25 "float" refrigerator unit 15 and provide pressure compensation therefor at all levels of pressure from sea level to the vacuum of space. Vibration isolators 27 (FIG. 1) and 57 (FIG. 2) when needed provide additional vibration damping for refrigerator unit 15. Flexible thermal strap 38 (20° K.) serves to provide essentially vibration free thermal contact between cold tip 32 of refrigerator unit 15 and the instrument component 37 mounted on TDL mount 36. Another flexible strap 41 (77° K.) serves to provide vibration free thermal contact between TDL mount thermal shroud 40 and thermal shroud 33 disposed about thermal shaft 34 at heat station 31.

13 Claims, 2 Drawing Figures

VIBRATION ISOLATION AND PRESSURE COMPENSATION APPARATUS FOR SENSITIVE INSTRUMENTATION

ORIGIN OF THE INVENTION

The invention described herein was made by an employee of the United States Government and may be manufactured and used by or for the Government for governmental purposes without the payment of any royalties thereon or therefor.

BACKGROUND OF THE INVENTION

In the continuing exploration of space, the National Aeronautics and Space Administration (NASA) is developing and implementing a comprehensive program of research and technology for monitoring the stratosphere to obtain increased knowledge and understanding of the physics and chemistry of the upper atmosphere. The development of highly sensitive instruments for remotely measuring the important chemical constituents of the atmosphere is an important aspect of this research. These instruments typically have a requirement for cryogenic cooling of the sensitive detectors and components that are necessary to detect the presence of the tenuous constituents of the atmosphere. Due to the extreme sensitivity of these instruments, it is necessary that the cryogenic coolers be closely integrated with the detectors to assure that temperature requirements will be satisfied and that the mechanical interfaces will be acceptable.

Future instruments will be required to perform a variety of missions including ground based observations, aircraft flights, balloon launches, rocket flights, and shuttle orbital missions. To satisfy the diverse requirements of these missions, increasing consideration is being given to closed cycle mechanical refrigerators to satisfy the need for efficient, reliable, and convenient cryogenic cooling.

However, the use of mechanical refrigerators can introduce dynamic vibration effects which have adverse effects on instrument performance. Since instrument detectors are optically coupled through the instrument to a signal source, any movement of the detector may result in defocusing and degradation of the instrument resolution. In addition, active elements such as tunable diode lasers (TDL) which may be used to generate a local oscillator reference signal in a heterodyne instrument are themselves sensitive to vibration and exposure to a dynamic environment may cause a shift in output frequency which will also have a deleterious effect on instrument sensitivity.

PRIOR ART

Various devices have been developed with the goal of achieving vibration isolation of a mechanical refrigerator from a cryogenically cooled TDL. A paper, "Shock Isolator for Diode Laser Operation on a Closed-Cycle Refrigerator", by Jennings and Hillman, Page 1568, Vol. 48, No. 12, December 1977, *Review of Scientific Instruments*, describes one approach being considered by NASA for flight instrumentation. In the Jennings and Hillman system, the cold tip is attached to a mechanical refrigerator which produces the cooling effect and associated mechanical vibrations or dynamic shocks. A Pb-In damper and braided ground strap provide thermal damping and thermal connection to the diode mount, with the strap providing a soft, flexible connection which effectively reduces and prevents direct transfer of dynamic motions from the cold tip to the diode mount. Both of these elements are well developed and commonly used in the art. The diode mount is rigidly attached to an optical bench through a combination of thermal insulation elements and intermediate heat stations which reduce the flow of parasitic heat from the ambient environment to the diode mount. This aspect of the Jennings and Hillman design is important since a stable diode mount must be achieved for optical alignment of the instrument while thermal losses are held to a minimum due to the limited refrigerator capacity usually available.

To further reduce thermal losses and to preclude atmospheric condensation the entire device is enclosed in a vacuum shroud and surrounded by an internal radiation shield. The vacuum shroud is closed on the mechanical refrigerator through a section of vacuum hose to provide some degree of vibration isolation and the mechanical refrigerator is mounted on a separate work bench.

An additional approach and similar to the Jennings and Hillman concept is described in Report No. 14238, Apr. 25, 1979 by G. N. Steinberg, Perkin-Elmer, Electro-Optical Division, Norwalk, Connecticut and entitled "Wavenumber Stability of a Laser Diode Mounted in a Closed Cycle Helium Refrigerator".

Another concept developed by Laser Analytics, Inc. and marketed as their Model TCR Stable Temperature Closed Cycle Refrigerator provides the cold finger and laser mount mechanically isolated by means of a braided copper strap. In this system the vacuum shroud is rigidly attached to the mechanical cooler, but isolated from the assembly mounting frame by metal bellows and the laser mount is supported from the assembly mounting frame by means of a thin fiberglass rod for thermal isolation. Vibration isolators are used to mount the entire frame on an optical bench.

All of the preceding examples of the current state-of-the-art are similar and have similar limitations. The most basic limitation is that only the problem of direct vibration transmission from the cold tip to the diode mount is addressed. While this is the most critical path for vibration transmission, it accounts possibly for only 60–90% of the vibration problem, since mechanical motion can be transmitted through the mounting frame, vacuum shroud, and diode mounting arrangement to adversely affect system performance. This secondary vibration can be particularly serious as instrument resolution is improved. For example, the Laser Analytics concept can account for diode instabilities observed in the laboratory of up to ±30 MHz. The referenced paper indicates that diode stabilities less than 5 MHz have been achieved with the Jennings/Hillman concept. However, it should be noted that this result is achieved by having the diode mount rigidly attached to an optical bench, which would be impractical for a flight instrument. The present invention has demonstrated 2 MHz frequency stability with no evidence of vibration.

Another limitation is that the refrigerator in each known system is not effectively isolated from its mounting arrangement. This is particularly serious for a flight-type instrument where the housing will likely be flexible and lightweight. The existing concepts rely on the mechanical damping of massive optical tables and benches to achieve vibration isolation.

An additional disadvantage of these concepts is that they are sensitive to atmospheric pressure. For example, the Perkin-Elmer type employs a metal bellows between the vacuum shroud and the optical bench. While the flexible metal bellows provides a measure of mechanical isolation, as designed, it is sensitive to external pressure. Thus, when the system is evacuated, the external atmospheric pressure will result in unbalanced external forces tending to compress the bellows along its central axis. These forces will tend to shift the entire vacuum shroud toward the support table with resultant change in position of the lens mount and possible optical defocusing.

It is thus seen that there is a definite need in the art for an improved vibration isolation and pressure compensation mounting system for sensitive instrumentation employed in aerospace research.

Accordingly, it is an object of the present invention to provide vibration isolation between a mechanical cryogenic refrigerator and sensitive instrument elements being cryogenically cooled thereby.

Another object of the present invention is to provide external pressure compensation for an evacuated housing containing pressure sensitive instrumentation at all ambient pressures within the range of sea level to space vacuum.

An additional object of the present invention is to provide vibration isolation of a cryogenic refrigerator from cryogenically cooled instrumentation and the housing therefor.

According to the present invention the foregoing and additional objects are attained by employing a mechanical cooling refrigerator "floated" between a sensitive instrument housing and a reaction mounting bracket via a pair of bellows and isolated from a instrument support platform by vibration isolators. The instrument housing is mounted directly to the instrument support platform and provides a rigid attachment for accurate and stable alignment of the tunable diode laser (TDL) mount contained therein. A second-stage cold tip extends from the mechanical cooler and is attached to the TDL mount via a 20° K. flexible thermal strap to thereby isolate direct mechanical vibrations from the cooler. A first thermal shroud extends over the TDL mount and is connected to and mechanically isolated from cooler vibrations via a 77° K. flexible thermal strap extending from another thermal shroud disposed about the mechanical cooler first-stage.

Secondary mechanical vibrations from the cooler mounting bracket are isolated from the instruments housing through a flexible isolation bellows, one of the bellows pair discussed hereinbefore. The other member of the bellows pair (reaction bellows) serves to secure the cooler to a reaction bracket integrally secured to the instrument platform. The reaction bellows is evacuated in common with the vacuum space provided within the housing assembly. Thus, the mechanical cooler is dynamically isolated from both the TDL mount and the instrument platform. The instrument bellows and the reaction bellows, working in conjunction, provide the mechanical cooler with the soft suspension necessary to isolate cooler vibrations and at the same time provide for ambient pressure compensation for all environmental conditions from sea level to deep space. External forces due to unbalanced pressure are absorbed by the reaction bracket and housing assembly and reacted through the instrument platform with no effect on the vibration isolation concept or on the instrument optical alignment.

BRIEF DESCRIPTION OF THE DRAWINGS

A more complete appreciation of the present invention and many of the attendant advantages thereof will become more readily apparent as the same becomes better understood with reference to the following detailed description when taken in conjunction with the accompanying drawings, wherein.

DETAILED DESCRIPTION OF THE INVENTION

Figure 1:
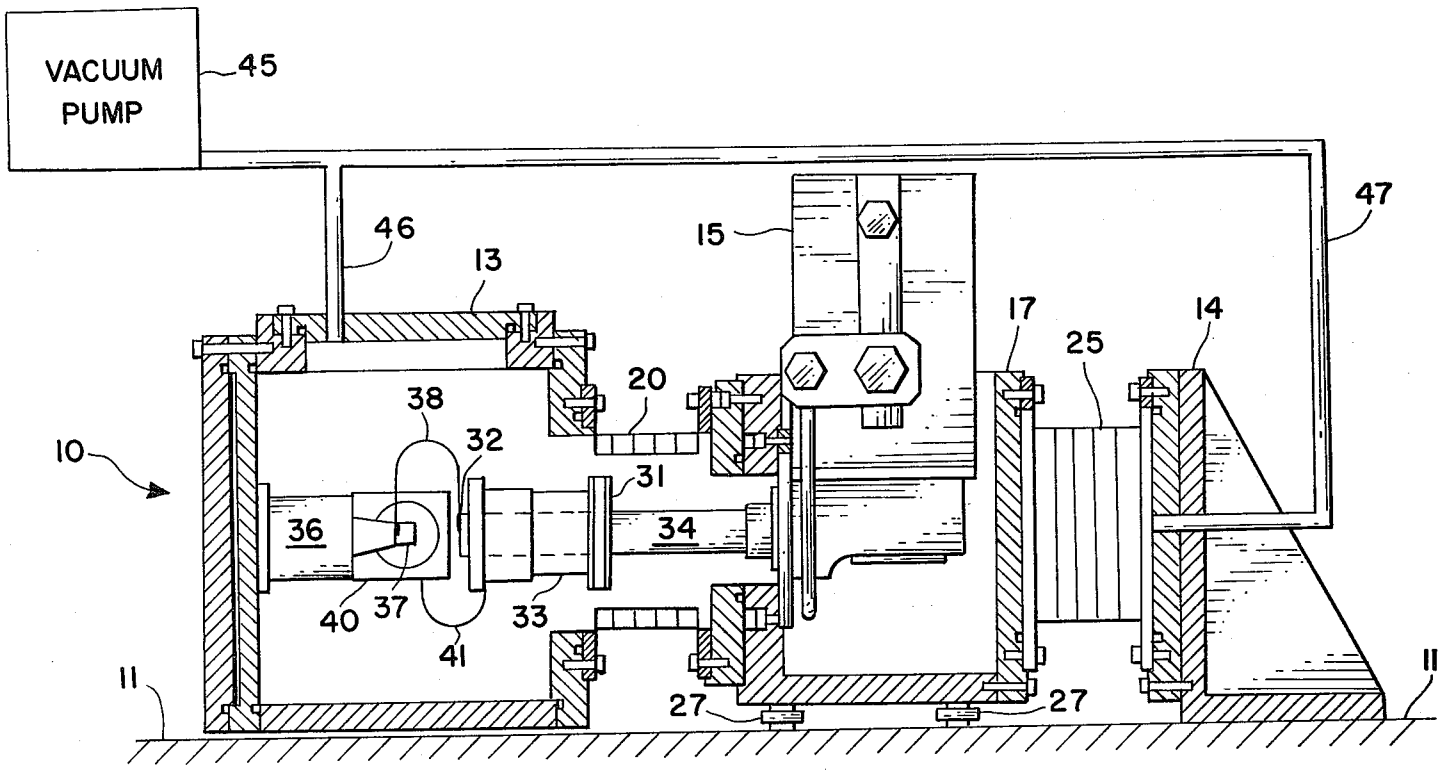
FIG. 1 is a part schematic, part sectional side elevation of an instrumentation system incorporating the vibration isolation and pressure compensation apparatus of the present invention.

Referring now to the drawings and more particularly to FIG. 1, there is shown an illustrative embodiment of the present invention wherein a sensitive instrumentation system (generally designated by reference number 10) is shown attached to an instrument platform 11. Instrumentation 10 includes a housing assembly 13 at one end thereof, a reaction bracket 14 at the other end thereof, and a mechanical cooler or refrigerator unit 15 intermediately disposed between housing 13 and bracket 14.

Figure 2:
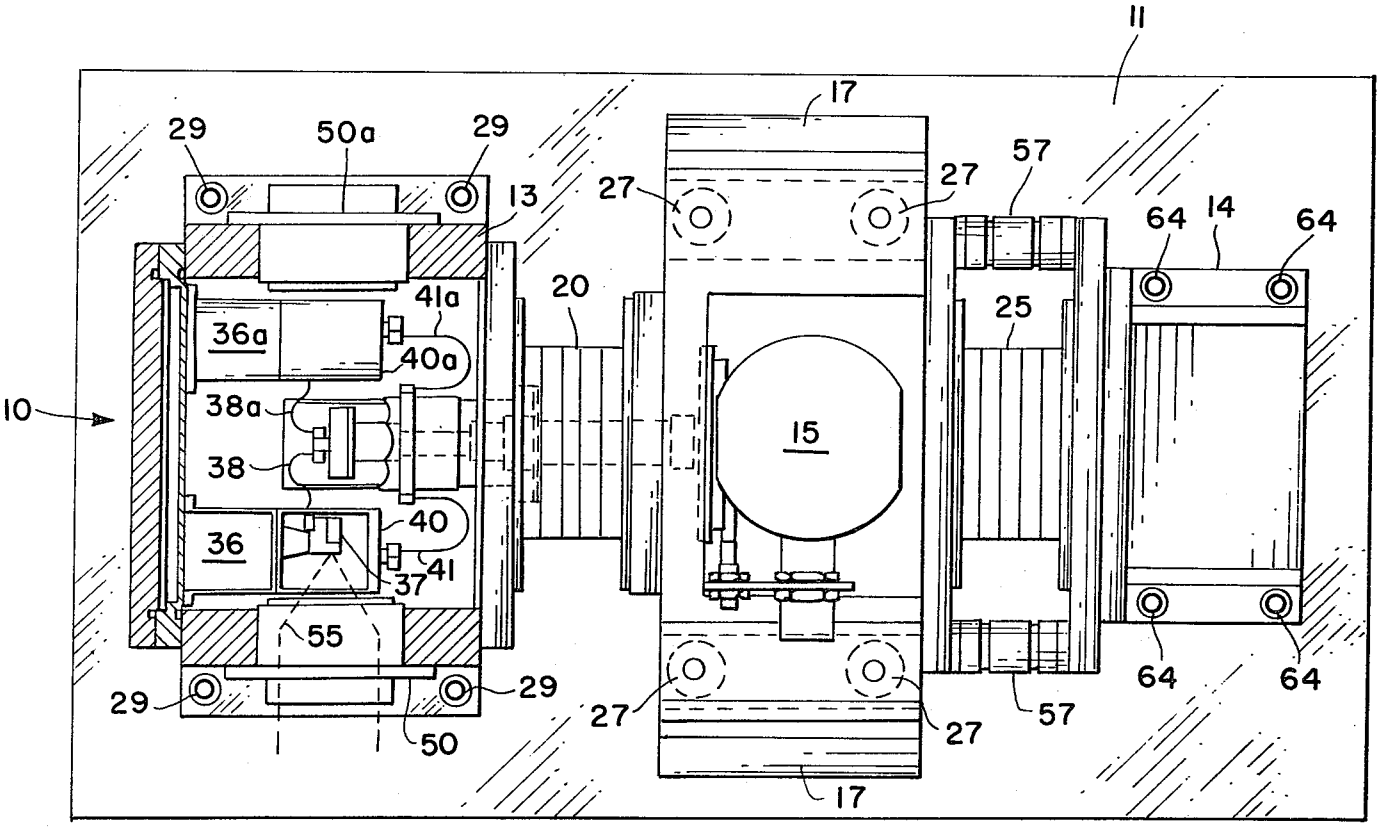
FIG. 2 is a top plan view of the instrumentation system shown in FIG. 1 with various features therein being alternative parts to that of FIG. 1.

A flexible isolation bellows 20 serves to connect cooler 15 to housing 13 as will be further explained hereinafter. A reaction bellows 25 serves to connect cooler 15 to reaction bracket 14 and a plurality of vibration isolators 27, (two of which are shown in FIG. 1) isolate cooler 15 from instrument platform 11. Thus, cooler 15, with any external attachments, is essentially "floating" between bellows 20, 25 and isolators 27. Housing 13 is mounted directly to instrument platform 11 via a plurality of connecting bolts 29 (FIG. 2). A first stage heat station 31 and a second stage cold tip 32 are provided on the end of thermal shaft 34 extending from cooler unit 15 into housing 13. A tunable diode laser (TDL) mount 36 extends from the interior of housing 13 toward cold tip 32. A 20° K. flexible strap 38 attaches cold tip 32 to the TDL 37 mounted on TDL mount 36 to thereby isolate direct mechanical vibrations from cooler 15. A tubular thermal shroud 40 is disposed around TDL mount 36 and is mechanically isolated from cooler 15 by a 77° K. flexible strap 41 leading to the first stage thermal shroud 33 and heat station 31. Thermal shrouds 33 and 40 intercept any parasitic heat flow to the respective elements protected thereby.

A vacuum system including vacuum pump 45 serves to evacuate housing assembly 13 via vacuum line 46 with simultaneous evacuation of reaction bellows 25 through vacuum line 47.

Referring now more particularly to FIG. 2, this embodiment is essentially identical to that of FIG. 1 except it is designed for a pair of tunable diode mounts 36 and **36*a* with duplicate 20° K. and 77° K. flexible straps 38, 38*a* and 41, 41*a* respectively providing thermal connection of the respective TDL mounts 36, 36*a* and thermal shrouds 40, 40*a*. Also shown in FIG. 2 are viewing lenses 50 and 50*a* provided in housing 13 to permit optical focusing on the TDL reference along the optical path, one of which is shown in dotted line and designated by reference number 55. A viewing port (not designated) is provided in thermal shrouds 40, 40***a* to permit focusing onto the TDL reference. Additional vibration isolators 57 are also shown in FIG. 2 and disposed between cooler mounting bracket 17 and reaction bracket 14. Isolators 57 as well as vibration isolators 27, are formed of a central solid rubber or other suitable pliable material with suitable rigid connecting shafts extending from each end thereof for connection with the adjacent structural elements. Also, bolts 64 connecting reaction bracket 14 to instrument platform 11 are illustrated in FIG. 2.

OPERATION

The operation of the invention is now believed apparent. Instrument package 10 is secured (as described) to instrument platform 11 rigidly attached to or forming part of a flight vehicle or the like. Vacuum pump 45 is employed as needed to evacuate the interior of housing 13 and connecting isolation bellows 20 via vacuum line 46 while reaction bellows 25 is evacuated through line 47. Suitable and conventional cutoff valves (not shown) permit removal of vacuum pump 45 and the associated tubing after instrumentation evacuation. Thus, cooler unit 15 is maintained "floating" between the bellows 20 and 25 while resting on vibration isolators 27. Both bellows are of the low spring constant flexible metal construction which greatly attenuate any dynamic motion of cooler 15 and thereby provide total dynamic isolation (along with vibration isolators 27) of cooler 15 from instrument platform 11. Also, the evacuation of housing 13 and bellows 20, 25 provides a balanced pressure compensated isolation over all ranges of ambient pressure from sea level to the vacuum of deep space with no adverse effect on the critical components of the instrument system.

It is thus seen that the present invention provides total dynamic isolation of cooler unit 15 from the sensitive instrument mount 36 while providing full pressure compensation regardless of ambient pressure. The instrument calibration is, accordingly, independent of any pressure variation which may be encountered during operation. Further, the modular construction (housing 13, reaction bracket 14, and refrigerator unit 15), being supported on a base plate or instrument platform 11, provides structural continuity between the individual components while simplifying the assembly and operation thereof.

This novel combination or modular construction utilizes the flexible characteristics of isolation bellows 20 and reaction bellows 25 to provide dynammic isolation of cooler unit 15 while preserving the necessary vacuum integrity of the system. Pressure compensation of the flexible bellows 20, 25 is obtained by disposing bellows 20, 25 in an opposed relationship on opposite sides of cooler 15 to permit the cooler unit 15 to "float" independent of external pressure. Further isolation and support for cooler 15 is provided by vibration isolators 27 disposed between cooler mounting bracket 17 and instrument platform 11, and vibration isolators 57, when needed, disposed between cooler unit 15 and reaction bracket 14.

The refrigerator or cooler unit 15 employed in the preferred embodiment of the present invention is the Gifford-McMahon cycle type, Model Number 21, available from Cryogenic Technology Inc. (CTI-Cryogenics) of Waltham, Mass. Other cooler types that provide cryogenic cooling are also applicable for use with the present invention including the Stirling cycle, Vuilleumier cycle, and Brayton cycle, each of which exhibit characteristic vibration environments that are deleterious to sensitive active and passive sensors as well as other sensitive instrumentation. The present isolation invention features are also applicable to other types of cryogenic refrigerators, for example, liquid helium (LHe) and liquid nitrogen ($LN_2$) dewars, or solid cryogenic coolers or radiators. These types of coolers are usually very passive and do not generate significant dynamic outputs to require vibration isolation, but may beneficially employ the pressure compensation feature. Bellows 20 and 25 in the preferred embodiment are commercially available from Standard Welded Bellows Co., Windsor Locks, Conn., CRES, Part No. 250-175-2—CC with a net spring rate of 17.25 lb/in. Vibration isolators 27 in the preferred embodiment are commercially available from the Barry Controls, Co., Watertown, Mass., Type No. A21-041.

Although the invention has been described relative to specific embodiments thereof, it is not so limited and many modifications and variations thereof will be readily apparent to those skilled in the art, in light of the above teachings without departing from the spirit and scope of the instant invention. For example, although embodiments are illustrated and described utilizing a single or two instrument component mounts, three or more such components and mounts could be employed when so desired. Also, other vibration isolators similar to those designated by reference numerals 27, 57 could be employed between the modules or between the modules and instrument platform 11 when so needed. In each of the illustrated embodiments shown and described herein, TDL mounts 36 and 36*a* may incorporate adjustment mechanism to permit external focusing of the TDL's. Further, although the vibration isolation and pressure compensation apparatus has been described herein as directed to specific instrumentation, it is equally applicable to other systems where mechanical isolation and pressure compensation is desirable; for example, to support motors, pumps, or other drive elements which penetrate the wall of an evacuated chamber. It is therefore to be understood that, within the scope of the appended claims, the invention may be practiced otherwise than as specifically described herein.

What is claimed as new and desired to be secured by Letters Patent of the United States is:

1. The combination of sensitive instrumentation for detecting and measuring chemical constituents of the atmosphere and a cooler unit for cryogenically maintaining components of the sensitive instrumentation at cryogenic temperatures during operation thereof, the improvement therewith comprising:

vibration attenuating mechanism for minimizing vibrations transmitted from the cooler unit to the sensitive instrumentation components, said vibration attenuating mechanism including a housing assembly module secured to an instrument platform and housing a mount therein for retaining a sensitive instrumentation component in fixed position;

a reaction bracket module also secured to the instrument platform and spaced from said housing assembly module;

a cooler unit module secured to the instrument platform intermediate said housing assembly module and said reaction bracket; and means for connecting said cooling unit module to said housing assembly module and said reaction bracket such that said cooling unit is substantially floating therebetween and vibrations inherent in said cooler unit operation are dampened and isolated from said sensitive instrumentation component.

2. The combination of claim 1 wherein said means for connecting said cooling unit module to said housing assembly module comprises an isolation bellows hermetically sealed to said housing assembly module and in fluid communication with the housing interior and the sensitive instrumentation component mounted therein.

3. The combination of claim 2 wherein an elongated thermal shaft extends from said cooler unit through said isolation bellows and into said housing assembly module.

4. The combination of claim 3 including a cold tip portion disposed on the end of said thermal shaft and terminating adjacent the sensitive instrumentation component mounted within said housing assembly and a first flexible strap thermal transfer connecting said cold tip to said sensitive instrumentation component.

5. The combination of claim 4 and further including a first tubular thermal shroud disposed on said mount for retaining said sensitive instrument component and having an end portion thereof surrounding and spaced from said sensitive instrument component.

6. The combination of claim 5 and including a second flexible strap thermal transfer connecting said first thermal shroud to another thermal shroud disposed about a segment of said thermal shaft.

7. The combination of claim 6 wherein multiple mounts are disposed within said housing assembly module for retaining multiple sensitive instrumentation components therein in fixed position, each of said multiple mounts being provided with individual thermal shrouds and each thermal shroud and each sensitive instrument component being in thermal contact with said cooler unit via individual flexible strap thermal transfer connection.

8. The combination of claim 1 wherein said means for connecting said cooling unit to said reaction bracket comprises a reaction bellows, and means in fluid communication with said reaction bellows for evacuating said reaction bellows.

9. The combination of claim 8 wherein said means in fluid communication with said reaction bellows is also in fluid communication with said housing assembly for evacuation thereof.

10. The combination of claim 9 wherein said means for connecting said cooling unit module to said housing assembly comprises an isolation bellows in fluid communication with the interior of said housing assembly module, said housing assembly module being also in fluid communication with said means for evacuating said reaction bellows whereby said reaction bellows, said isolation bellows and said housing assembly are simultaneously evacuated.

11. The combination of claims 2 or 8 and further including a plurality of vibration isolators disposed between said cooler unit module and said instrument platform.

12. The combination of claim 8 and including a plurality of vibration isolators disposed between and connected to said cooler unit and said reaction bellows.

13. The combination of claim 1 wherein the sensitive instrument component is a tunable diode laser employed to generate a local oscillator reference signal in a heterodyne instrument and an optical lens provided in said housing assembly to permit optical focusing communication with said tunable diode laser.

* * * * *